US006755357B2

(12) United States Patent
Duqueroie et al.

(10) Patent No.: US 6,755,357 B2
(45) Date of Patent: Jun. 29, 2004

(54) SPRAY CONTAINER DEVICE

(75) Inventors: Florent Duqueroie, Paris (FR); Alain Bethune, Savigny (FR)

(73) Assignee: L'Oreal, Paris (FR)

( * ) Notice: Subject to any disclaimer, the term of this patent is extended or adjusted under 35 U.S.C. 154(b) by 252 days.

(21) Appl. No.: 10/075,198

(22) Filed: Feb. 15, 2002

(65) Prior Publication Data

US 2002/0117519 A1 Aug. 29, 2002

(30) Foreign Application Priority Data

Feb. 16, 2001 (FR) ..... 0102164

(51) Int. Cl.[7] ..... B65D 1/32

(52) U.S. Cl. ..... 239/327; 239/302; 239/323; 239/600; 222/92; 222/107; 222/206; 222/541.6

(58) Field of Search ..... 239/302, 309, 239/323, 327, 328, 338, 373, 600; 222/92, 94, 107, 206, 207, 211, 212, 215, 541.6, 541.9, 621, 630

(56) References Cited

U.S. PATENT DOCUMENTS

| | | | | | |
|---|---|---|---|---|---|
| 54,394 | A | * | 5/1866 | Olmsted | 222/211 |
| 644,703 | A | * | 3/1900 | Buckley | 239/327 |
| 2,080,864 | A | | 5/1937 | Hilts | 43/146 |
| 3,412,907 | A | | 11/1968 | Faso | 222/187 |
| 3,471,064 | A | * | 10/1969 | Micallef | 222/211 |
| 3,897,005 | A | | 7/1975 | Reiner | 239/327 |
| 4,047,642 | A | * | 9/1977 | Nilson | 222/94 |
| 5,664,704 | A | * | 9/1997 | Meadows et al. | 222/209 |

FOREIGN PATENT DOCUMENTS

| | | |
|---|---|---|
| EP | 0 412 524 | 2/1991 |
| EP | 0761314 | 3/1997 |
| FR | 2443980 | 7/1980 |
| FR | 2778639 | 11/1999 |
| JP | 52-111913 | 8/1977 |
| JP | 55-129643 | 9/1980 |
| JP | 1-82186 | 6/1989 |
| JP | 3-198866 | 8/1991 |

* cited by examiner

*Primary Examiner*—Robin O. Evans
(74) *Attorney, Agent, or Firm*—Oblon, Spivak, McClelland, Maier & Neustadt, P.C.

(57) ABSTRACT

A spray container device for a fluid product is disclosed. The device includes a container having at least one compressible wall. A first end of the container delimits a first opening for filling the container with a fluid product. The first opening is sealed after filling of the container. A second end of the container is closed and is capable, prior to the first use of the device, of being opened so as to uncover a second opening through which the product can be dispensed. The device further includes an insert arranged inside of the container. The insert delimits a spray orifice in communication with the product. The spray orifice faces the second opening. The insert is also preferably configured to isolate the product from the first opening prior to the sealing thereof.

41 Claims, 4 Drawing Sheets

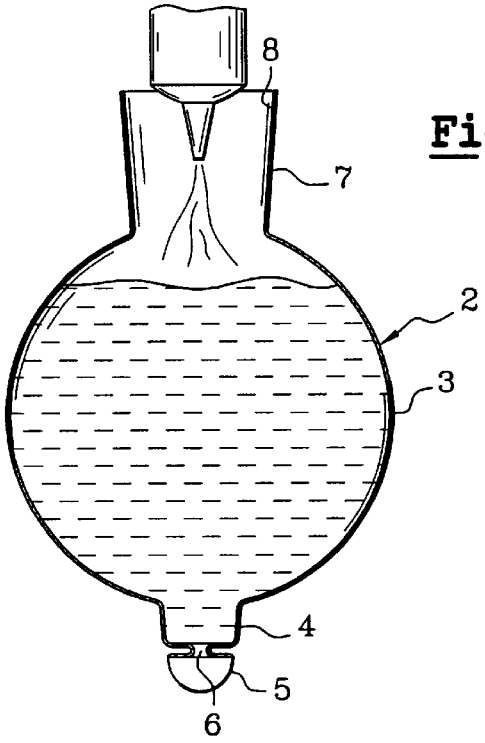
Fig. 3A
Fig. 3B
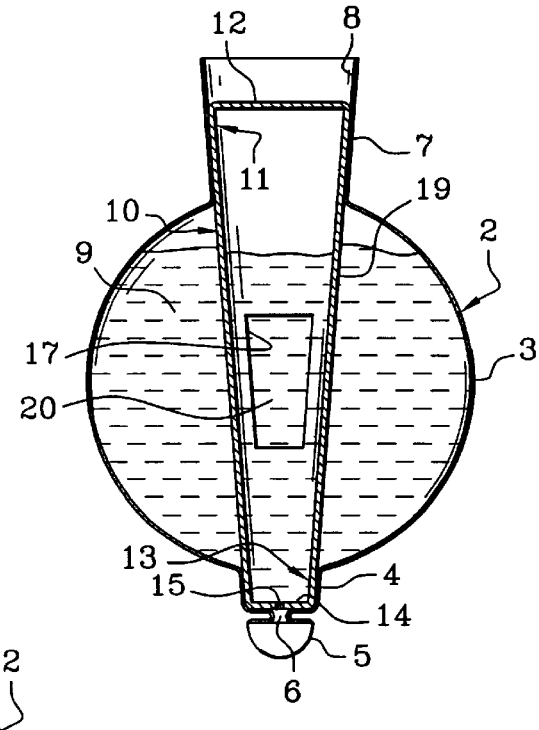
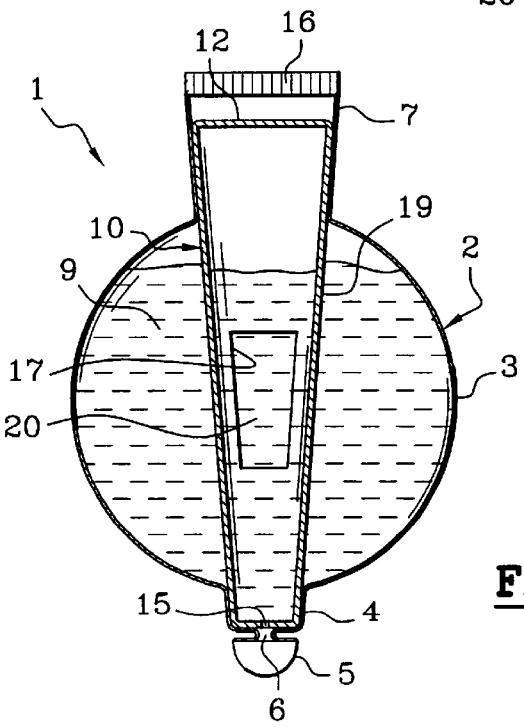
Fig. 3C

Fig. 4A
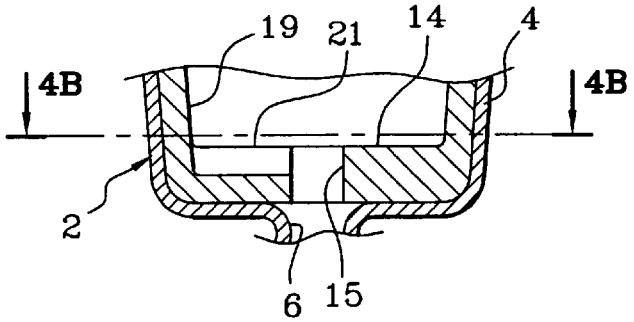
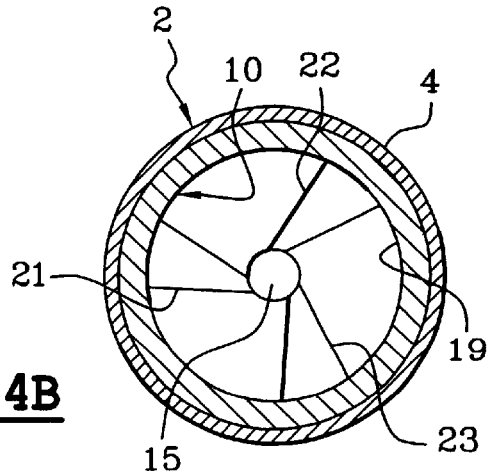
Fig. 4B
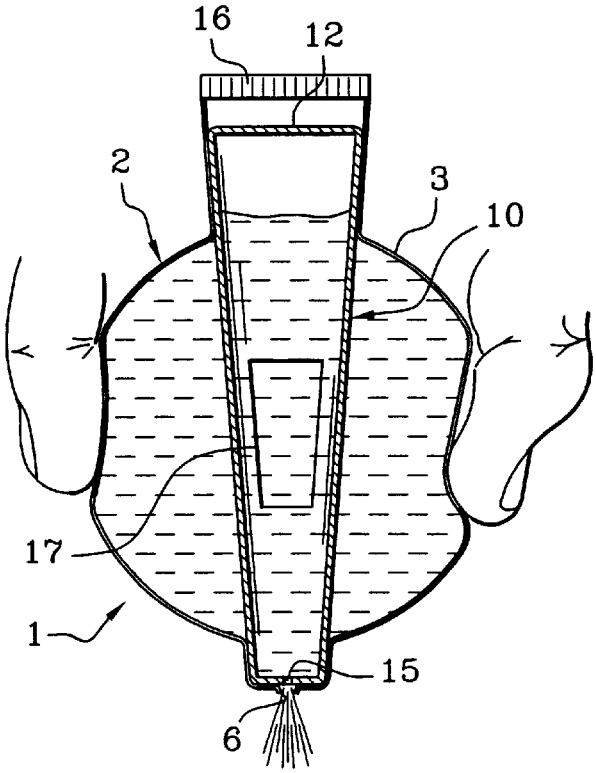
Fig. 5

SPRAY CONTAINER DEVICE

FIELD OF THE INVENTION

The present invention relates to a device for packaging a fluid product and dispensing it in the form of a spray. More specifically, the invention relates to a small or miniature spray, preferably a disposable one, designed for packaging cosmetic products. The spray device can be particularly advantageous for fragrances or scents, especially with products to be provided in the form of samples. The product is preferably liquid but may also be in the form of a powder, particularly powders having small particle sizes.

BACKGROUND OF THE INVENTION

Discussion of Background

Dispensers for fluids are described in patent applications FR-A-2 778 639, EP-A-0 761 314, and FR-A-2 443 980, and in patents U.S. Pat. No. 3,897,005 and U.S. Pat. No. 3,412,907. These devices primarily suffer from at least one deficiency or problem associated with the cost of manufacture, the ease of use, or the quality of the spray the device is capable of producing.

Particularly with respect to samples that are not generally intended for sale, the cost of manufacture for the packaging/dispenser needs to be as low as possible. For such samples it is desirable to utilize packaging and dispensing devices in which the components can be easily produced in large quantities and in which the components can be easily assembled. Furthermore, the devices need to be able to generate a good and uniform or consistent spray.

One possibility for producing such packagings at the lowest possible cost could include producing the container in the form of a pod of the type commonly used for packaging certain physiological serums, ointments or make-up removal products. Such a pod is made of a single piece with a spray orifice which is opened by tearing off an end piece, particularly by twisting the end piece about the axis of the orifice. Such a device may be filled via an open end of the container. The end is then closed by welding. However, this solution suffers from two major disadvantages. The first stems from the fact that, upon opening, the orifice resulting from tearing-off of the end piece by twisting has an imprecise or inconsistent shape and/or size. As a result, the spray that can be obtained through such an orifice, when the compressible walls of the container are pressed, has characteristics which significantly vary from one device to another. Often, the cross section of the orifice is such that it is impossible to generate a spray, and the product can merely run out in somewhat large drops or as a continuous stream.

In addition, the welding operation to close the container after filling, particularly in the case of a highly volatile product such as a scent, can be problematic. There is a risk that the product will evaporate, deteriorate, or even catch fire due to the heat which can be associated with welding to seal the opening. Such problems can occur with a configuration as described in U.S. Pat. No. 2,080,864 which describes a device for spraying an insecticide. This device is in the form of a pyramid-shaped sachet, inside of which there extends a tube in communication with the container via lateral openings. One end of the tube has an opening facing a spray orifice of the sachet. The other end is closed and secured, via a spring, to an element intended to form an attached bottom of the sachet so as to seal its opposite end to the spray orifice. Thus, it is not until the opening opposite the spray orifice is closed that the element secured to the tube isolates the product from the opening. Such a configuration thereby precludes any closure operation involving a supply of heat, for the reasons discussed above.

SUMMARY OF THE INVENTION

In view of the foregoing, it is an object of the invention to provide a spray device which completely or partially solves the problems discussed above.

In accordance with one object of the invention, a spray device is provided which is easy to produce in large quantities at a low cost.

In accordance with another object of the invention, a device is provided which makes it possible to generate a spray, the quality of which is both satisfactory and more consistent or reproducible from one device to another.

In accordance with a further object, a device is provided in which the filling orifice can be sealed hot, while the risk of causing appreciable evaporation, deterioration, or fire/combustion of the product is reduced.

Other objects and advantages will become apparent in the detailed description herein.

A device for spraying a fluid product in accordance with the invention includes a container with at least one compressible wall. A first end of the container delimits a first opening which is sealed after the container is filled with a product. A second end of the container includes a closed portion which is capable, prior to the first use of the device, of being opened so as to uncover or provide a second opening through which the product can be dispensed. The device further includes an insert arranged inside of the container, with the insert delimiting a spray orifice in communication with the product and arranged to face the second opening. In addition, the insert is configured to isolate the product from the first opening prior to the sealing thereof. As used herein, a "fluid product" includes a liquid or a powder.

According to a preferred embodiment of the invention, the portion of the insert which is intended to isolate the product from the first opening lies a non-zero axial distance away from the first opening, thus making it possible to isolate the product from the opening and then to seal the latter. Such is not the case if the portion intended to isolate the product from the opening also serves to seal the opening. Thus, in accordance with the invention, a portion of the insert isolates the product from the first opening so that upon sealing (such as by welding) of the first opening, the product is isolated from the location being sealed.

In accordance with one aspect of the invention, a single insert element can be used to isolate the product from the first opening and at the same time, to provide the spray orifice, whose dimensions can be chosen as precisely as possible. As a result, the quality of the spray meets expectations and is more consistent or constant from one device to another. Furthermore, prior to the closure operation, the product and the filling orifice are isolated which, if necessary, allows the sealing or closure of the first opening to be performed hot, while reducing the risk of the product evaporating, deteriorating or combusting.

In accordance with another advantageous aspect, the device can be configured such that it is possible to produce the container as a single piece, including the element for closing the dispensing orifice. The cost of manufacture is thereby reduced. In addition, sealing of the closure is more efficient or optimal.

Preferably, and unlike the configuration described in U.S. Pat. No. 2,080,864 mentioned above, after the first opening has been sealed, the spray orifice is in a fixed axial position inside the container. This arrangement can provide far better precision in the spraying of the product. In addition, the arrangement is substantially easier to assemble, and the cost of the device can be appreciably reduced.

Preferably, the first end of the container lies opposite to the second along a longitudinal axis X of the device. This aligning of the insert along the axis X of the device to a large extent makes the device according to the invention easier to assemble and fill.

According to a preferred form of the invention, the insert forms an inner volume in communication with the spray orifice. In addition, an outer volume, in communication with the inner volume, is delimited between the insert and the container. In accordance with an example of a preferred form of the invention, the insert can be configured in the form of a tubular element, a first end of which is closed and a second end, at an end of the tube opposite to the first, of which has the spray orifice passing through it. In addition, at least one aperture can be formed in a side wall of the tubular element so as to provide communication between the inner volume and the outer volume. The aperture can also be arranged as close as possible to the spray orifice so as to ensure that the container is emptied as completely as possible. Preferably, two apertures are arranged diametrically opposite each other on the side wall of the insert.

According to another preferred aspect of the invention, the insert is shaped such that first and second ends of the insert mate with correspondingly shaped first and second ends of the container. This arrangement assists in ensuring that the product exits through the spray orifice of the insert and also in isolating the fluid product from the opening in the container through which the fluid product is filled into the container. This arrangement is also advantageous in achieving and maintaining the desired position of the insert in the container.

According to a further preferred aspect, the first opening can be delimited by a frustoconical portion of the compressible-wall container at the first end of the container, with the cross section of the frustoconical portion increasing toward the first opening. Similarly, the tubular element also preferably has a frustoconical shape at least over part of its height engaged with the frustoconical portion of the container, so as to sit in a sealed manner therein. This configuration provides a simple way of isolating the product inside the container from the opening that is to be sealed after filling. The insert preferably also has a frustoconical shape extending over its entire height. Although the portion of the container adjacent the first opening and the insert preferably have frustoconical shapes, it is to be understood that other shapes are also possible.

The first opening is preferably closed by a weld, for example by a thermal or ultrasound weld, or by bonding. This technique is commonly used for closing packagings in the form of tubes, such as are commonly used for packaging gels, care creams or sun products. The isolation achieved by the insert between the product and the opening makes it possible, when the latter is to be hot sealed, to appreciably reduce the risks of the product evaporating, deteriorating or catching fire.

By way of example, according to a preferred form of the invention, the container is preferably molded, particularly by extrusion blow-molding, with the second opening being sealed at the second end of the container by a closed portion molded integrally with the container. The seal at the second end of the container end can be torn off, for example, in response to twisting of the closed portion about the axis of the second opening. The container may be made of a thermoplastic material, particularly of a low-density polyethylene material.

The insert can also be formed as a single piece obtained by molding, and particularly by rotational molding, of a thermoplastic such as a polyethylene or a polypropylene. Alternatively, the insert can be formed by assembling two or more parts which, for example, are molded or otherwise formed separately.

According to an exemplary embodiment, the container has at least one curved wall, preferably having a substantially spherical shape between the first end and the second end of the container. This configuration can be advantageous in creating enough volume inside the container so that it can contain the desired quantity of product. Furthermore, this arrangement encourages adequate and uniform pressurizing of the container and the spraying of the product under good conditions. However, it is to be understood that other container shapes could also be utilized.

The spray orifice can be formed in an end wall of the insert. Optionally, an internal surface of the wall is hollowed out or grooved to form a number of swirl-inducing passages or channels opening into the spray orifice. Passages of this type are commonplace in the nozzles used particularly in certain aerosol or pump-action devices. These passages allow the product to be accelerated near the spray orifice, and allow the quality of the spray to be improved.

The device according to the invention is particularly advantageous for packaging and dispensing a sample dose of a cosmetic product, and is particularly advantageous for samples of a fragrance or scent.

According to another aspect of the invention, an advantageous method for packaging a fluid product is also provided. The method includes introducing the product through a first opening delimited by a first end of a container, with the container having at least one compressible wall. The second end of the container is closed at a closed portion which is able to be opened prior to the first use of the device so as to uncover a second opening through which the product can be dispensed. An insert is then introduced through the first opening, with the insert delimiting a spray orifice in communication with the product inside the container. After introduction of the insert into the container, the spray orifice is arranged to face the second opening. In addition, the insert is configured in such a way as to isolate the product from the first opening prior to the sealing thereof. After the insert is introduced into the container, the first opening is sealed.

BRIEF DESCRIPTION OF THE DRAWINGS

A better appreciation of the invention and many of the attendant advantages thereof will become further apparent from the following detailed description, particularly when read in conjunction with the accompanying drawings in which:

FIGS. 3A–3C illustrate the filling of the device depicted in FIGS. 1 and 2;

FIGS. 4A–4B illustrate a detail view of an alternative form of FIGS. 1 and 2; and FIG. 5 illustrates the use of the device depicted in FIGS. 1 and 2.

DETAILED DESCRIPTION OF THE PREFERRED EMBODIMENTS

Figure 1:
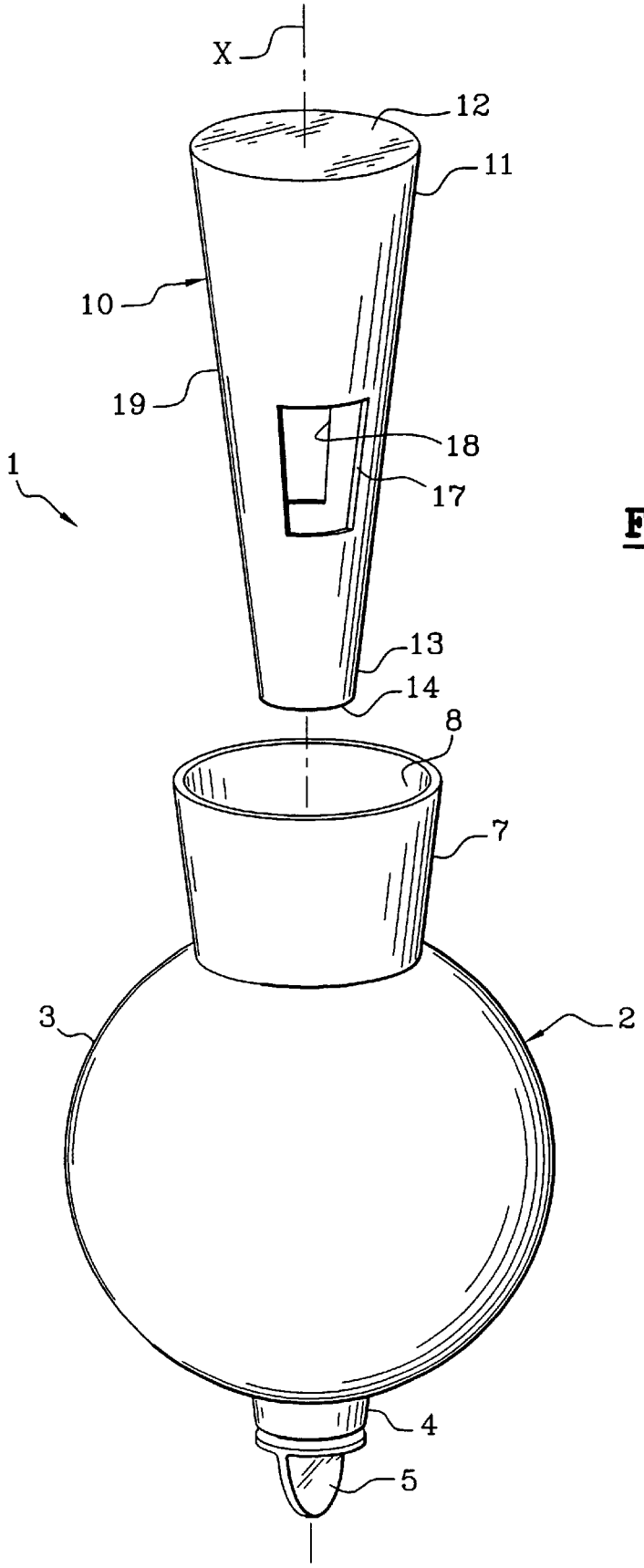
FIG. 1 is an exploded view of one embodiment of the device according to the invention, prior to filling.
Figure 2:
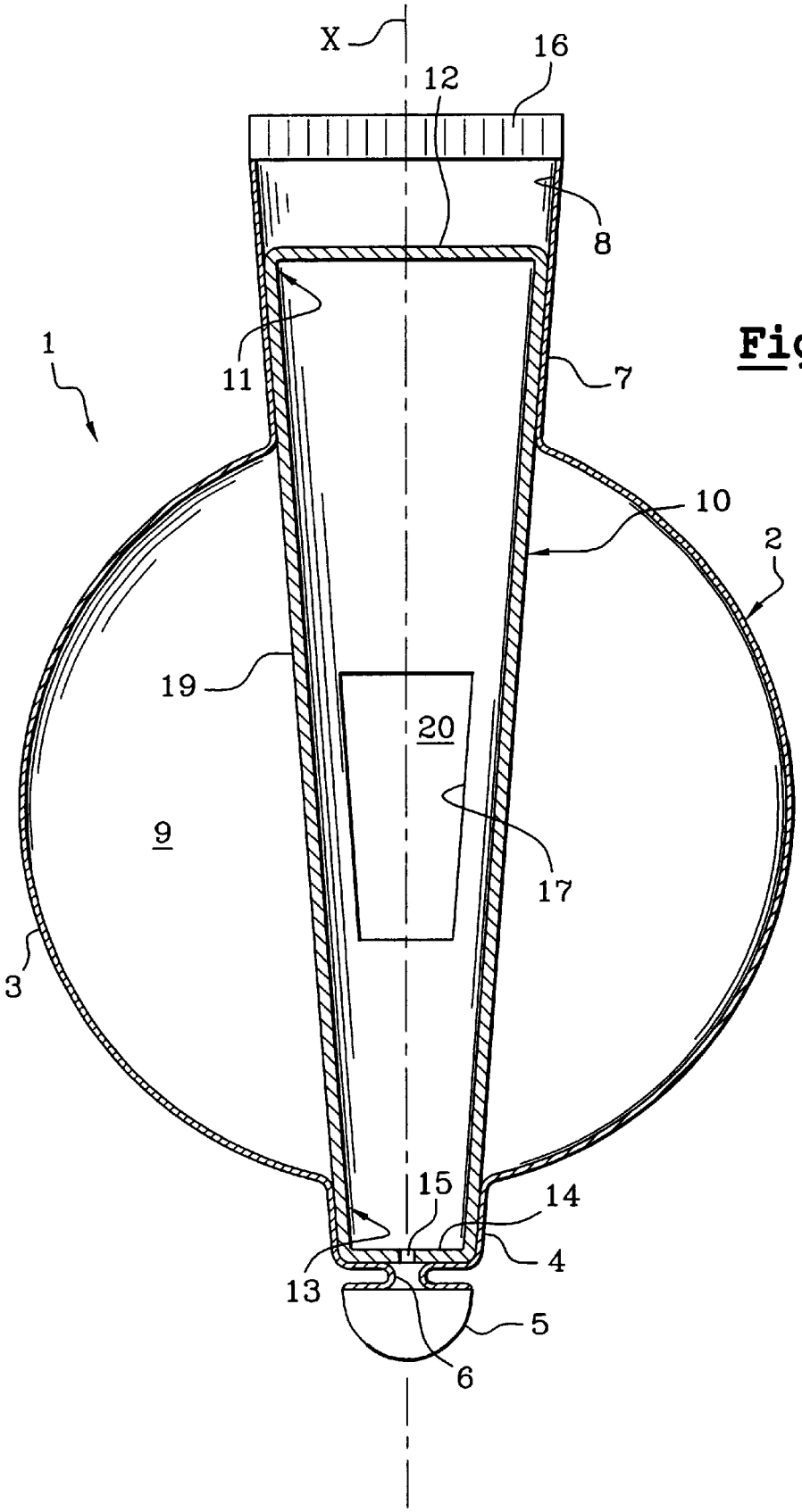
FIG. 2 is a view in cross-section of the device of FIG. 1.

FIGS. 1 and 2 illustrate a first exemplary embodiment of the device 1 according to the invention. The device 1 includes a container 2, which is preferably obtained by extrusion blow-molding of a low-density polyethylene. The container preferably has a spherical body 3, however other shapes are also possible. The spherical body 3 is in communication with a slightly frustoconical end part 4 which extends toward an opening 6. This end of the container is sealed by an end piece or closed portion 5 which can be torn off by twisting it about the axis X of the end part 4. Upon removal of the closed portion 5, the opening 6 is exposed so that the product can be dispensed.

The spherical body 3 also extends to an end part 7, diametrically opposite the end portion 4. The end portion 7 preferably also has a frustoconical shape, with a free edge delimiting an opening 8.

The device 1 further includes a tubular insert 10, which preferably also has a frustoconical shape. The larger cross section end 11 of the insert 10 is closed by a transverse wall 12. The other end 13 of the insert 10 is closed by a transverse wall 14, through the center of which there passes a spray orifice 15 whose characteristics, particularly dimensional characteristics, are chosen according to the desired characteristics of the spray. The insert 10 may also be obtained by molding, for example by rotational molding of a material that is flexible enough that it can be elastically compressed. By way of example, and not to be construed as limiting, the insert can be formed of a polyethylene material. Also, by way of example, for a fragrance or scent, the diameter of the spray orifice 15 is on the order of 0.5 mm.

The cross section of the cone frustum formed by the insert 10 is chosen so that when the insert 10 is arranged inside the container 2, as depicted in FIG. 2, the larger cross section end 11 sits in a sealed manner against the interior walls of the end portion 7 of the container 2. Thus, the opening 8 is isolated in a sealed manner from the spherical body 3 of the container 2. Likewise, the smaller cross section end 13 sits in a sealed manner against the interior walls of the end portion 4 of the container. Thus, the product cannot leave other than via the spray orifice 15. After filling, as we will see in greater detail hereinafter, the opening 8 is sealed, for example, by hot welding along a weld zone 16. The weld zone 16 could also be formed by other expedients, such as by ultrasonic welding or bonding.

In the embodiment illustrated in FIGS. 1 and 2, two diametrically opposed apertures 17, 18 are formed in the side wall 19 of the insert 10. The apertures are arranged approximately mid-way along the axial height of the insert and allow communication between the inner volume 20 formed inside of the insert 10 and the outer volume 9 surrounding the insert 10. If desired, the apertures could also be formed at locations other than the mid-way location shown. When this insert 10 is in the position in which it is fitted inside the container 2, the spray orifice 15 faces the orifice 6 of the container 2, with the orifice in communication with the product contained in the device 1 via the apertures 17 and 18.

FIGS. 3A–3C, to which reference is now made, illustrate the steps of filling the device 1 discussed with reference to FIGS. 1 and 2. In FIG. 3A, the container 2 is inverted, head down. The opening 6 is sealed by the tear-off end piece or closed portion 5. As shown, in this condition the product can be introduced into the container 2 via the opening 8.

As shown in FIG. 3B, the insert 10 is then introduced into the container 2 until the end wall 14 of the insert is in abutment against the smaller cross section portion of the container 2 delimiting the orifice 6. In this position, the spray orifice 15 faces the opening 6, and the end portion 11 of the insert 10 rests in a sealed manner against the interior walls of the frustoconical part 7 of the container 2. In this position too, the end wall 12 of the insert 10 is a few millimeters away from the free edge of the container delimiting the opening 8. The product is present both in the annular volume 9 and in the inner volume 20, via the apertures 17 and 18.

The opening 8 is then hot welded along a weld line 16 as shown in FIG. 3C. The axial height of the insert 10 with respect to the axial height of the container 2 is chosen so that the edges delimiting the opening 8 can be welded together along the entire width of the opening. Preferably, the height of the insert is also such that, upon closing or sealing of the opening 8, the insert 10 cannot move appreciably in an axial direction within the container 2.

FIGS. 4A and 4B depict an embodiment detail of an alternative form of the previous embodiment. According to this embodiment, the interior surface of the wall 14 of the insert 10 is hollowed or grooved with three swirl-inducing passages 21, 22, 23 extending from the side wall 19 of the insert and up to the spray orifice 15. Such passages allow the product to be accelerated near the spray orifice so as to produce a finer spray.

FIG. 5 schematically illustrates the use of the device discussed with reference to FIGS. 1 and 2. By pressing on the spherical part 3 of the container 2, the product is pressurized inside the container and forced out in the form of a cloud or mist of fine droplets or particles through the spray orifice 15 and the opening 6. By releasing the pressure on the wall of the container 2, the container reverts to its initial shape, the volume of product dispensed being compensated for by a corresponding volume of air. When the entire contents of the device 2 have been sprayed, the device can be discarded.

Obviously, numerous modifications and variations of the present invention are possible in light of the above teachings. It is therefore to be understood that, within the scope of the appended claims, the invention may be practiced otherwise than as specifically described herein.

What is claimed is:

1. A spray container device for a fluid product comprising:

(a) a container having:

(i) at least one compressible wall;

(ii) a first opening disposed at a first end of said container, wherein said first opening allows for filling of said container with said fluid product, and wherein said first opening is sealed after filling;

(iii) a closed portion disposed at a second end of said container, wherein said closed portion is capable of being opened to provide a second opening at said second end of said container;

(b) an insert disposed inside of said container, said insert including:

(i) a spray orifice disposed adjacent said second end of said container such that said spray orifice faces said second opening when said closed portion is opened; and (ii) wherein a portion of said insert is disposed between the fluid product and the first opening to isolate the fluid product from the first opening before the first opening is sealed.

2. A spray container device as recited in claim 1, wherein said portion of said insert is spaced a non-zero axial distance from said first opening prior to sealing of said first opening.

3. A spray container device as recited in claim 1, wherein after sealing of said first opening, the spray orifice of said insert is disposed at a substantially fixed axial position inside of said container.

4. A spray container device as recited in claim 1, wherein said first and second ends of said container are disposed along an axis of the container, and wherein said first and second ends are disposed at opposite ends of said container along said axis.

5. A spray container device as recited in claim 1, further including:

an inner volume disposed inside of said insert, wherein said inner volume is in communication with said spray orifice; and an outer volume disposed inside of said container, wherein said outer volume is disposed between said insert and said at least one compressible wall of said container, and wherein said outer volume is in communication with said inner volume.

6. A spray container device as recited in claim 5, wherein said insert is in the form of a tubular element having at least one side wall, said insert including a first closed end and a second end at an opposite end of said insert, wherein said spray orifice extends through said second end of said insert, and wherein at least one aperture extends through said at least one side wall of said tubular element to provide communication between the inner volume and the outer volume.

7. A spray container device as recited in claim 6, wherein at least two diametrically opposed apertures extend through said at least one side wall of said tubular element.

8. A spray container device as recited in claim 1, wherein the first opening is delimited by a frustoconical portion of said container, said frustoconical portion having a cross-section which increases in a direction toward said first opening.

9. A spray container device as recited in claim 8, wherein said insert has a frustoconical portion disposed in said frustoconical portion of said container to provide a seal between said insert and said container.

10. A spray container device as recited in claim 9, wherein said insert has a frustoconical shape along its entire height.

11. A spray container device as recited in claim 1, wherein said first opening is closed by one of a thermal weld, an ultrasonic weld and a bonded seal.

12. A spray container device as recited in claim 1, wherein said container is a molded container, and wherein said closed portion at said second end of said container is integrally molded with said container.

13. A spray container device as recited in claim 12, wherein said container is a blow-molded container, and wherein said closed portion can be tom-off by twisting said closed portion to provide said second opening.

14. A spray container device as recited in claim 1, wherein said container is formed of a thermoplastic material.

15. A spray container device as recited in claim 14, wherein said container is formed of a low density polyethylene.

16. A spray container device as recited in claim 1, wherein said container has a substantially spherical shape between said first end and said second end.

17. A spray container device as recited in claim 1, wherein said spray orifice extends through an end wall of said insert, and wherein an inner surface of said end wall includes a plurality of swirl-inducing channels extending to said spray orifice.

18. A spray container device as recited in claim 1, wherein said container contains a cosmetic product.

19. A spray container device as recited in claim 1, wherein said container contains a fragrance.

20. A method of packaging a fluid product in a spray container device comprising:

(a) providing a container having:

(i) a first opening disposed at a first end of said container;

(ii) a closed portion disposed at a second end of said container, wherein said closed portion is capable of being opened to provide a second opening at said second end through which the fluid product can be dispensed;

(b) introducing the fluid product into the container through said first opening;

(c) introducing an insert into said container through said first opening after introducing the fluid product, said insert including:

(i) a spray orifice which faces said closed portion after said insert is introduced into said container;

(ii) said insert further including a portion disposed between the fluid product and the first opening of the container after the insert is introduced into said container to isolate the fluid product from said first opening; and (d) sealing said first opening after introducing said insert into said container.

21. A method as recited in claim 20, further including providing said insert with a height such that said insert is in a substantially fixed position upon sealing of said first opening.

22. A method as recited in claim 20, wherein said insert has a shape at a first end of said insert which mates with a shape of said first end of said container upon introduction of said insert into the container to thereby assist in isolating the fluid product from the first opening.

23. A method as recited in claim 22, wherein said insert has a shape at a second end of said insert which mates with a shape of said second end of said container upon introduction of said insert into said container.

24. A method as recited in claim 23, wherein said shape of said insert at said first end is frustoconical and said shape of said insert at said second end is frustoconical.

25. A method as recited in claim 20, further including providing as said closed portion of said container, a closed portion which can be torn off to provide said second opening such that upon tearing off of said closed portion said fluid product can be dispensed through said spray orifice and said opening.

26. A spray container device for a fluid product comprising:

(a) a container having:

(i) at least one compressible wall;

(ii) a first opening at a first end of said container, wherein said first opening allows for filling of said container with said fluid product and wherein said first opening is sealed after filling;

(iii) a closed portion disposed at a second end of said container, wherein said closed portion is capable of being opened to provide a second opening at said second end of said container;

(b) an insert disposed inside of said container, said insert including:

(i) a spray orifice, said spray orifice disposed at an end of said insert which is adjacent to said second end of said container such that said spray orifice faces said second opening when said closed portion of said container is opened; and (ii) wherein said end of said insert adjacent to said second end of said container has a shape which mates with a shape of said second end of said container such that upon opening of said closed portion and compressing of said at least one compressible wall, the fluid product is sprayed through said spray orifice of said insert and out of said container through said second opening.

27. A device as recited in claim 26, wherein said insert and said first opening are sized such that said insert can be inserted into said container through said first opening.

28. A device as recited in claim 26, wherein said insert extends from said first end of said container to said second end of said container such that when said first opening of said container is sealed said insert is in a substantially fixed position.

29. A device as recited in claim 28, wherein said insert includes an end adjacent to said first end of said container, and wherein said end adjacent to said first end of said container has a shape which mates with a shape of said first end of said container.

30. A device as recited in claim 29, wherein said shape of said end of said insert adjacent to said first end of said container is frustoconical and said shape of said end of said insert adjacent to said second end of said container is frustoconical.

31. A device as recited in claim 29, wherein said insert includes an inner volume, and wherein an outer volume is disposed between said insert and said at least one compressible side wall of said container, said insert further including at least one aperture to provide communication between said outer volume and said inner volume such that when said closed portion is opened and said at least one compressible side wall is compressed, said fluid product passes from said outer volume, through said at least one aperture, through said inner volume, through said spray orifice and through said second opening.

32. A device as recited in claim 31, wherein said closed portion is capable of being torn off to provide said second opening.

33. A device as recited in claim 31, wherein said insert includes a closed end wall at said end adjacent to said first end of said container such that said insert isolates said product from said first opening, whereby said first opening is isolated from said fluid product during sealing of said first opening.

34. A device as recited in claim 26, wherein said insert includes an inner volume, and wherein an outer volume is disposed between said insert and said at least one compressible side wall of said container, said insert further including at least one aperture to provide communication between said outer volume and said inner volume such that when said closed portion is opened and said at least one compressible side wall is compressed, said fluid product passes from said outer volume, through said at least one aperture, through said inner volume, through said spray orifice and through said second opening.

35. A device as recited in claim 26, wherein said insert includes a closed end wall adjacent to said first end of said container such that said insert isolates said product from said first opening, whereby said first opening is isolated from said fluid product during sealing of said first opening.

36. A device as recited in claim 26, wherein said at least one compressible wall is curved.

37. A device as recited in claim 26, wherein said at least one compressible wall is substantially spherical.

38. A spray container device comprising:

(a) a container comprising:
- (i) at least one compressible wall;
- (ii) a first end;
- (iii) a second end, said second end including a closed portion capable of being opened to form an opening in said container;

(b) an insert disposed inside of said container comprising:
- (i) a first end adjacent to said first end of said container;
- (ii) a second end adjacent to said second end of said container;
- (iii) at least one side wall such that said insert defines an inner volume inside of said at least one side wall, and wherein an outer volume is defined between said at least one side wall of said insert and said at least one compressible wall of said container;
- (iv) at least one aperture to provide communication between said outer volume and said inner volume; and
- (v) a spray orifice disposed at said second end of said insert such that said spray orifice faces said closed portion of said container;

wherein opening of said closed portion exposes said spray orifice such that said fluid product can be sprayed out of said container through said spray orifice of said insert, wherein said insert as a frustoconical shape.

39. A spray container device as recited in claim 38, wherein said first end of said container and said second end of said container have frustoconical shapes and wherein said first end is larger in diameter than said second end.

40. A spray container device as recited in claim 39, wherein said at least one compressible wall of said container is spherical and is disposed between said first end and said second end of said container.

41. A spray container as recited in claim 40, wherein said container includes an opening at said first end and wherein said opening is sealed, and further wherein prior to sealing of said opening, said insert is capable of being inserted through said opening and after insertion of said insert through said opening said insert isolates said opening from said fluid product so that said opening is isolated from said fluid product upon sealing of said opening.

* * * * *

UNITED STATES PATENT AND TRADEMARK OFFICE

CERTIFICATE OF CORRECTION

PATENT NO. : 6,755,357 B2
DATED : June 29, 2004
INVENTOR(S) : Florent Duqueroie et al.

It is certified that error appears in the above-identified patent and that said Letters Patent is hereby corrected as shown below:

Column 10,
Line 35, change “as” to -- has --.

Signed and Sealed this

Twenty-sixth Day of October, 2004

JON W. DUDAS
*Director of the United States Patent and Trademark Office*